US006073722A

United States Patent [19]

Babuke et al.

[11] Patent Number: 6,073,722

[45] Date of Patent: Jun. 13, 2000

[54] ANECHOIC ROOM FOR THE ENTIRE AUDITORY RANGE

[75] Inventors: Gerhard Babuke, Weil der Stadt; Dietmar Eckoldt, Aidlingen; Helmut Fuchs, Weil; Moritz Spaeh, Schwaebisch-Gmuend; Xueqin Zha, Boeblingen, all of Germany

[73] Assignee: Fraunhofer Gesellschaft zur Foerderung der angewandten Forschung E.v., Germany

[21] Appl. No.: 09/148,542

[22] Filed: Sep. 4, 1998

[30] Foreign Application Priority Data

Sep. 4, 1997 [DE] Germany ..... 197 38 757

[51] Int. Cl.[7] ..... E04B 1/99

[52] U.S. Cl. ..... 181/30; 181/290; 181/295

[58] Field of Search ..... 181/290, 295, 181/286, 30, 294

[56] References Cited

U.S. PATENT DOCUMENTS 5,750,944 5/1998 Fuchs ..... 181/290

*Primary Examiner*—Khanh Dang

*Attorney, Agent, or Firm*—Evenson, McKeown, Edwards & Lenahan, P.L.L.C.

[57] ABSTRACT

A low reverberating room for the entire auditory range. In particular, for low frequency ranges below 100 Hz, in which the walls and ceiling are covered with sound absorbers. The sound absorbers on a surface of about 70–90% of a room, not including the floor, have a depth of <0.5 m preferably <0.3. The sound absorber also has a closed, plane but acoustically permeable surface, are built up of multiple layers. The sound absorbers are about 20–70% in similarity to composite-plate resonators. They are also provided with inside plates, made of metal or heavy foil, which are designed of varying thickness for absorption in various frequency ranges.

33 Claims, 17 Drawing Sheets

ANECHOIC ROOM FOR THE ENTIRE AUDITORY RANGE

BACKGROUND AND SUMMARY OF THE INVENTION

The present invention relates to a room with low reflections in which sound waves are strongly absorbed within the entire auditory range of 20 Hz to 16 KHz such that (in particular, in small rooms) sound fields are created only by the sources in the room without disturbing reflections from the walls, the ceiling and (under certain circumstances) the floor.

Waves emitting from sound sources in a free sound field (reflection-free surfaces) form a typical acoustic field. The human ear, also manmade acoustic sensors, with which the sound field (e.g., as a musical performance) is subjectively perceived or (e.g., as emission from a noise source) objectively judged, react very sensitively to sound wave reflections from the surrounding boundaries in a room. Therefore, enclosed rooms need to be covered with more or less acoustically absorbing peripheral surfaces which absorb the impinging sound waves strongly enough so that the reflections from the surrounding surfaces (generated by one or multiple sound sources) do not disturb the freefield condition in the room. This falsification must be neither subjectively perceivably, nor objectively measurably beyond certain limits within the entire audible range of interest from approximately 20 Hz to approximately 16 KHz.

State-of-the-art anechoic room coverings fulfill their function with a conventional covering depth of up to approximately 1 m, from approximately 80 Hz upward. In order to dampen 20 Hz reflections effectively, walls, ceiling and floors of rooms would have to be covered on all surfaces to a depth of a few meters with conventional sound absorbers (usually mineral wool). As all-surface room coverings of this type require a lot of space, as well as complicated mounting, anechoic rooms intended for measuring purposes are usually designed only for frequencies above 100 Hz with a covering of barely 1 m in depth. In rooms intended for hearing or measuring only low frequencies, according to the state of the art, less covering depths and additional "edge absorbers" with correspondingly greater depths are built into the corners and edges of the rooms as special "low frequency absorbers" (Everest, F. A.: The Master Handbook of Acoustics: New York; McGraw-Hill 1994, pp. 342 ff.).

When designing high-grade sound studios, acoustic specialists try to create, in general, a certain "room impression", in particular, in which to play music. The widespread attempts to obtain a certain "diffusivity" in the room, via reflections, inevitably leads (at low frequencies) to excitation of the cavity resonances of the room and consequently to falsifying the sound occurrences. This manifests itself as an unpleasant "droning" in the room.

The currently valid standards and guidelines (DIN 45 635, Part 1: Gerauschmessung an Maschinen. Erlauterungen zu den Gerauschemissions-Kenngrossen. ISO 37 45: Acoustics, determination of sound power levels of noise sources, Precision methods for anechoic and semi-anechoic rooms) set forth strict criteria:

(a) According to the standards and guidelines, the degree of absorption of the room cladding should be at least 99% (at vertical sound incidence). In order for the reflections of the peripheral surfaces of the room to remain under 1% of incident sound energy, the prevailing opinion is to make extreme demands on material and design for the acoustical room covering which cannot be met by a normal, sound absorbing layer in front of the peripheral surfaces.

(b) To the drafters of the pertinent standards, realization of the extreme criteria for anechoic rooms (as stated in (a) above) seems only possible using covering depths of one quarter of the wavelengths of the deepest frequency to be measured (e.g. 1 m for 80 Hz and 2.50 m for 30 Hz).

(c) Someone skilled in the art knows that such thick absorbing layers cannot be realized with a sufficiently small flow resistance in order to even come close to meeting the extreme criteria (as discussed in (a) above). However, the pertinent standards suggest a very uneven covering of wedges, pyramids or cubes made of special fibrous or porous damping material. The prevailing opinion is that if the sound waves impinge vertically into these structures, they can be ensured sufficient depth of penetration and thus almost full absorption.

(d) Finally the valid abovementioned standards for designing anechoic rooms for precision measuring uniformly prescribe that the absorbing covering should be distributed in the same manner and evenly over all the peripheral surfaces. This prescription, in particular, suggests that the special problems of the free sound field condition for low frequencies in small rooms apparently has not been properly understood (Zha, X.; Fuchs. H. V.; Spah, M.: Messung des effectiven Absorptiongrades in kleinen Raumen. Rundfunktechn. Mitteilung 40 (1996), H. 3, S. 77–83).

Moreover, these same guidelines and textbooks prescribe that measurement points in a room should always maintain a distance of a quarter of the wavelength ($\lambda$) from the covering (for instance from the tips of the wedges) and a distance ($\lambda$) from the sound source. This yields, depending on the size of the assumedly cubic source (located in the center of a cubic all surface conventional anechoically clad room), the bottom critical frequency which is dependent on the unclad-construction volume shown in FIG. 1. According to this, in order to still be able to measure at, e.g., 50 Hz, the room would have to be made 10000 $m^3$, which due to cost and space limitation is impossible in practice. In rooms, which are usually smaller than 700 $m^3$, according to these widespread conceptions (even at small sound sources), only measurements above approximately 125 Hz can be conducted. With these design criteria, about 30% of the unfinished construction volume must still be wasted on the thick covering of the room! If the room is not cubic or cuboid in shape and/or the source is moved out of the center of the room, measuring low frequencies is even more difficult.

As a result of various prejudices (regarding sound studios and rooms for precision measuring, in particular), small rooms with a volume of 50 to 400 $m^3$ have subjective and objective drawbacks at low frequencies below 125 HZ. Consequently, voluminous "bass traps" are scattered about in sound studios (FIG. 2(*a*) thru 2(*d*)). This impairs the sound field of the room. Precision measuring rooms are clad (e.g. according to FIG. 3) with wedges up to 3 m in length.

Thus an object of the present invention is to provide a low reverberating room that is able to absorb 95% of sound from 16 KHz down to 25 Hz.

This and other objects and advantages are achieved by the anechoic room according to the present invention in which the walls and ceilings are covered with sound absorbing materials.

Other objects, advantages and novel features of the present invention will become apparent from the following detailed description of the invention when considered in conjunction with the accompanying drawings.

BRIEF DESCRIPTION OF THE DRAWINGS

FIG. 1(*b*) is a schematic view of an anechoic room of the type contemplated by the present invention;

FIG. 4(*b*) shows the fundamental buildup of the covering of anechoic room, constituted according to a second preferred embodiment of the invention;

FIG. 4(*c*) shows the fundamental buildup of the covering of anechoic room, constituted according to a third preferred embodiment of the invention;

DETAILED DESCRIPTION OF THE DRAWINGS

Figure 6:
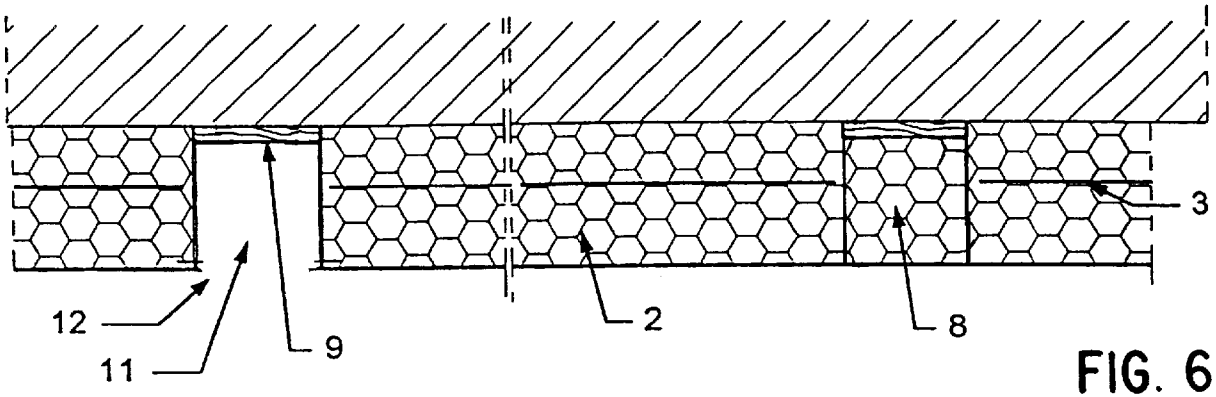
FIG. 6 depicts a cross section of a ceiling covering with a closed joint system, constituted according to a preferred embodiment of the invention.
Figure 7:
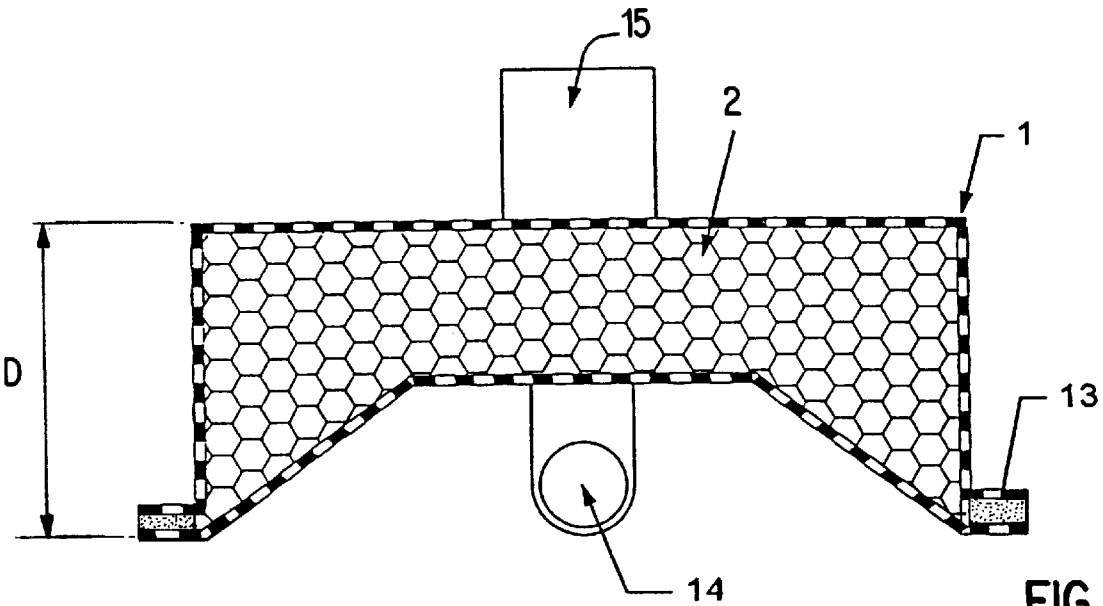
FIG. 7 shows a cross section of a lamp element with a closed joint system, according to a preferred embodiment of the invention.

The anechoic room in the present invention differs from state-of-the-art sound studios and precision measuring rooms in the following ways:

1. The walls, ceiling (semi-free sound field space) and floor (free sound field space) of a room are provided with a covering having a constant depth of only 0.25 m.
2. The covering has a completely plane, wall surface-parallel, optically and haptically closed, but entirely acoustically permeable surface.
3. The actual sound absorber, which is set up in a normal manner to the peripheral surface like a composite-plate resonator (DE 195 06 511, Fuchs, H. V.; Zha, X.: Wirkungsweise und Auslegungshinweise fuer Verbund-Platten-Resonatoren, Zeitschrift fur Larmbekampfung 43 (1996), H. 1, pp. 1–8) in multiple layers, is located behind a suitable covering, e.g., of perforated sheet metal or expanded metal (1) with a free surface of at least 30% (FIG. 4(*a*) thru 4(*c*)).
4. The layered buildup of the cladding is varied laterally (in the wall, ceiling and floor surface) in such a manner that the sound field in the room between the covered surfaces will be as uniform as possible from centrally or decentrally disposed sound sources in the entire auditory range. Fundamentally, the resonators with thicker plates 3 and 6 (FIGS. 4(*a*) thru 4(*c*)) tuned to lower frequencies are directed toward the corners and edges of the room. On the other hand, thinner plates 3 are preferred in the center of the wall and the ceiling surfaces. Instead, the thinner plates are completely omittable in order to preferably absorb high and medium frequencies with a homogeneous layer of, e.g., 250 mm porous or fibrous material.
5. The anechoic covering built up of plates can be advantageously covered with perforated plates or can be framed in a perforated cage and attached to massive construction components. However, they also permit the integration of, e.g., installation channels (FIG. 5) and lamps (FIGS. 6–7). As for the noise emissions coming from these built-in components, the absorbing layers can be designed and utilized as silencers, e.g., regarding the electric fluorescent light ballast 15 in FIG. 7.
6. The robust, abrasion-proof, compact and self-contained construction of the absorber module is not only suited for covering massive construction components, but especially for free-standing lightweight construction (in which the plane modules, e.g., according to FIG. 4(*c*) are inserted between stand constructions of U or double T moldings (FIGS. 8 and 9)). Thus, sound studios and precision measuring rooms, e.g., in large workshops, can be erected in a simple, cost favorable, variable and reversible manner, i.e., in a room within-a-room construction. The function of sound insulation from the inside to the outside and from the outside to the inside to be performed by the room covering is then substantially influenced by the basis weight and rigidity of plate 6.

Figure 10:
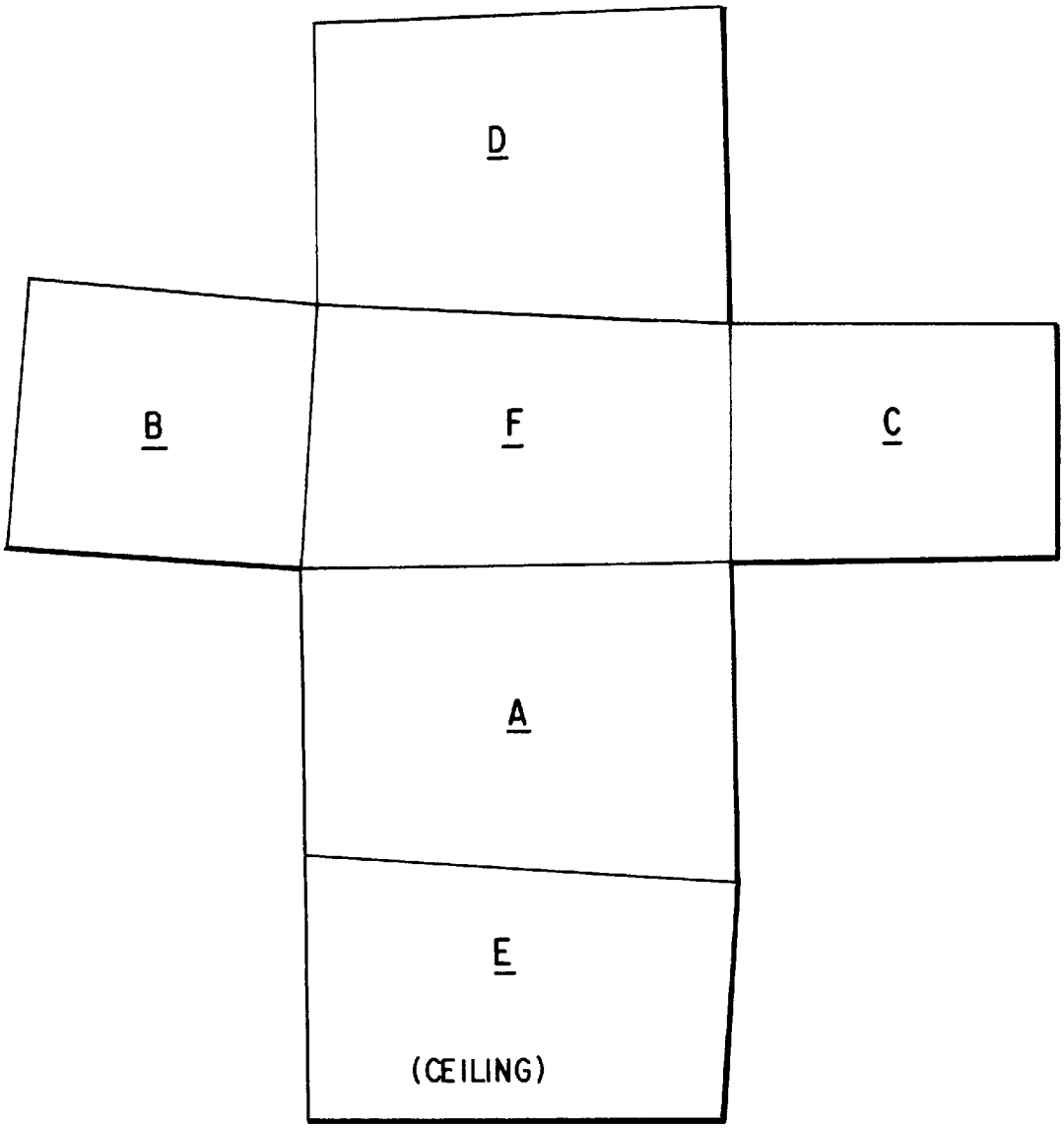
FIG. 10 shows a plan view of the unclad reverberant surfaces of the anechoic room prior to insertion of the modules, according to the invention.
Figure 11:
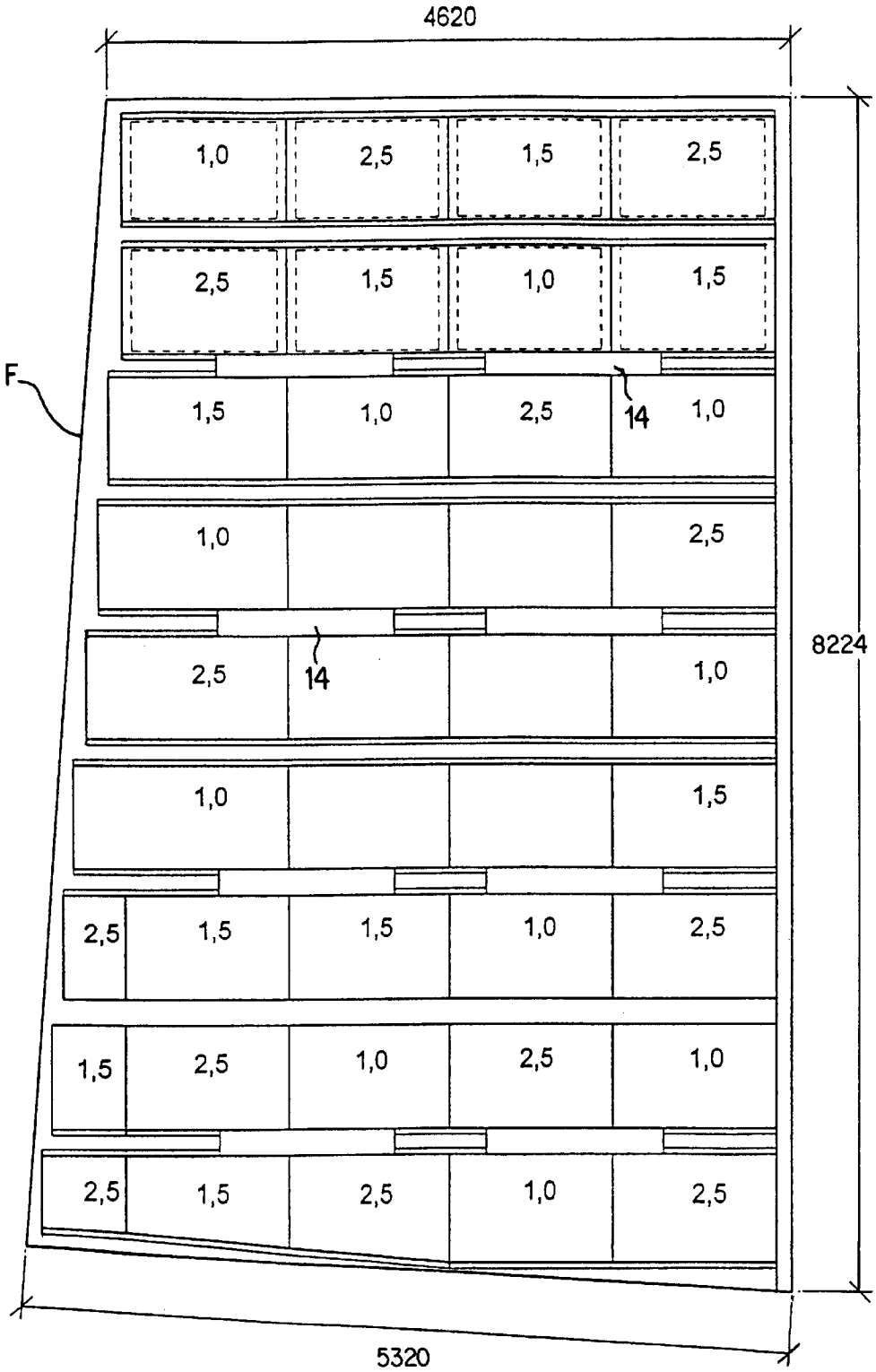
FIG. 11 is a plan view of a ceiling of the unclad anechoic room as shown in FIG. 10, with modules configured thereon according to the invention.
Figure 12:
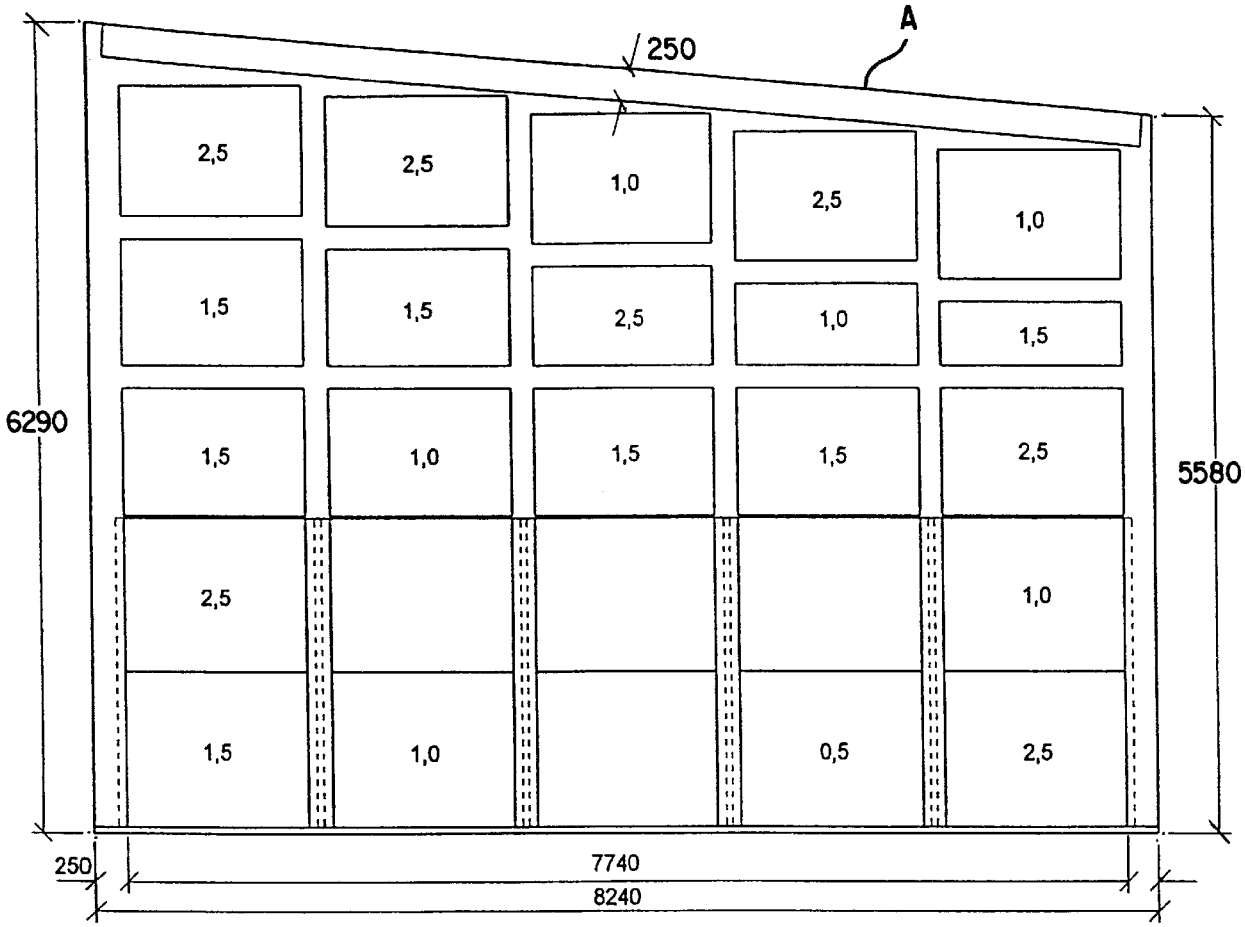
FIG. 12 is a plan view of wall A of the anechoic room as shown in FIG. 10, with modules configured thereon according to the invention.
Figure 13:
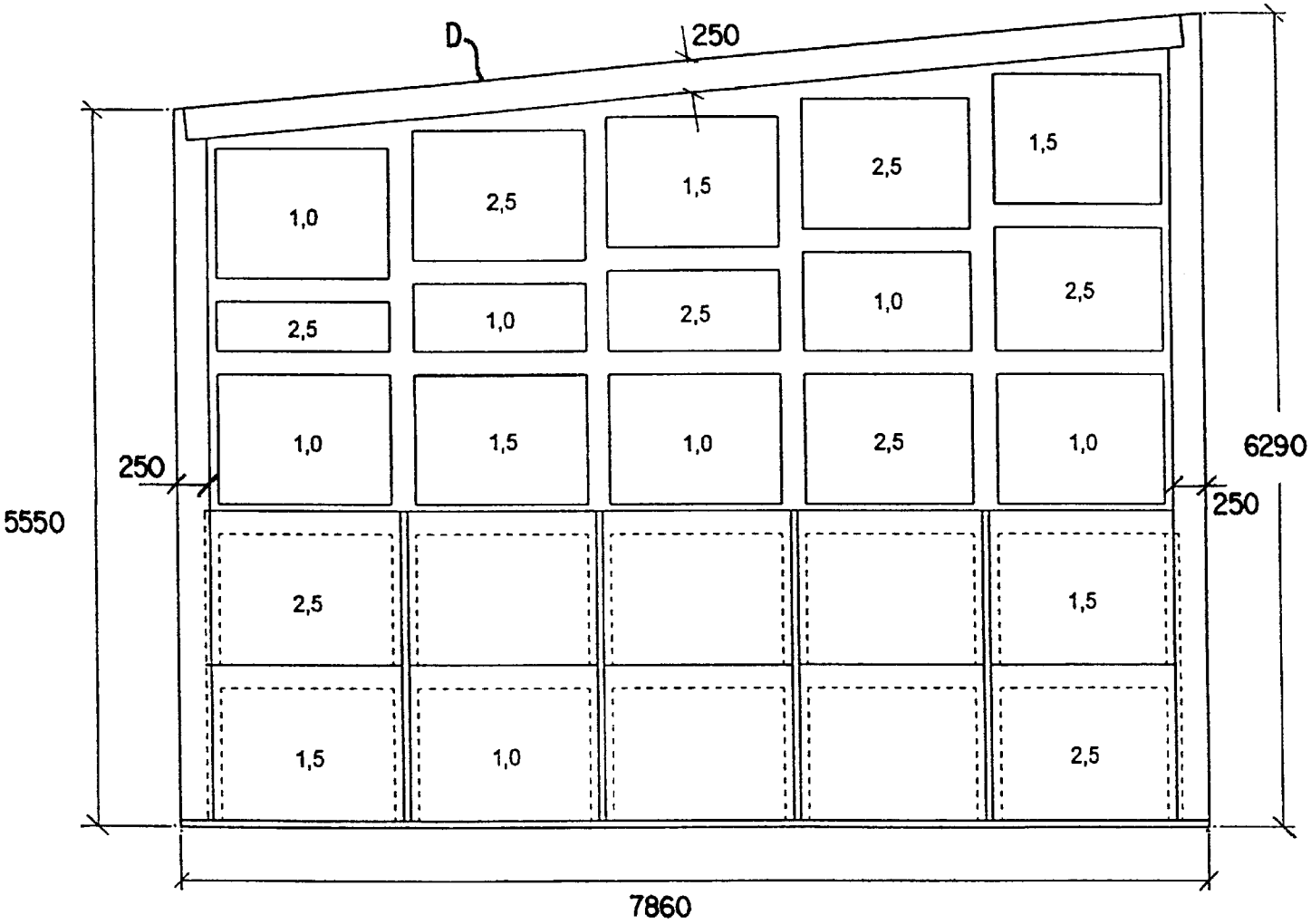
FIG. 13 is a plan view of wall D of the anechoic room as shown in FIG. 10, with modules configured thereon according to the invention.
Figure 14:
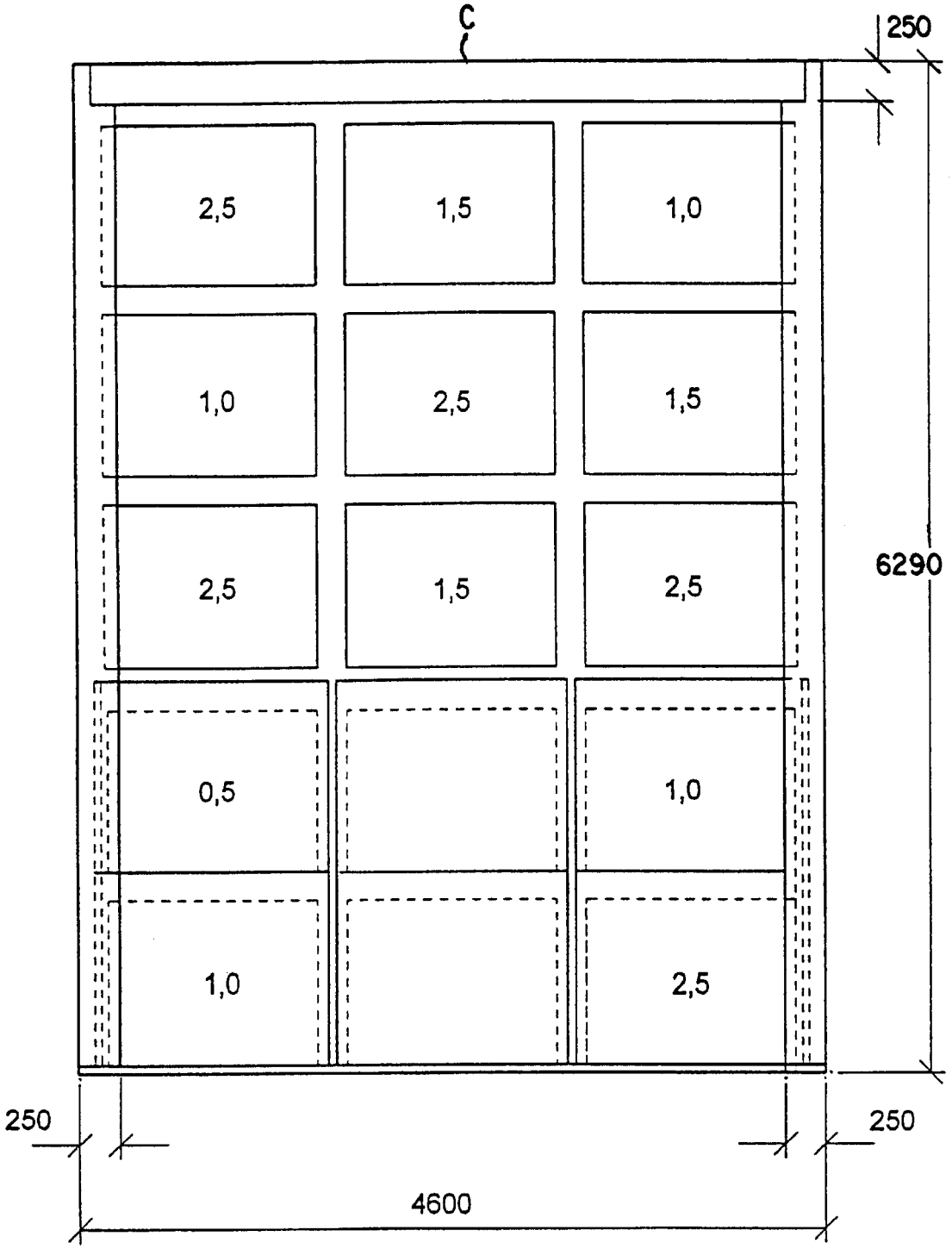
FIG. 14 is a plan view of wall C of the anechoic room as shown in FIG. 10, with modules configured thereon according to the invention.
Figure 15:
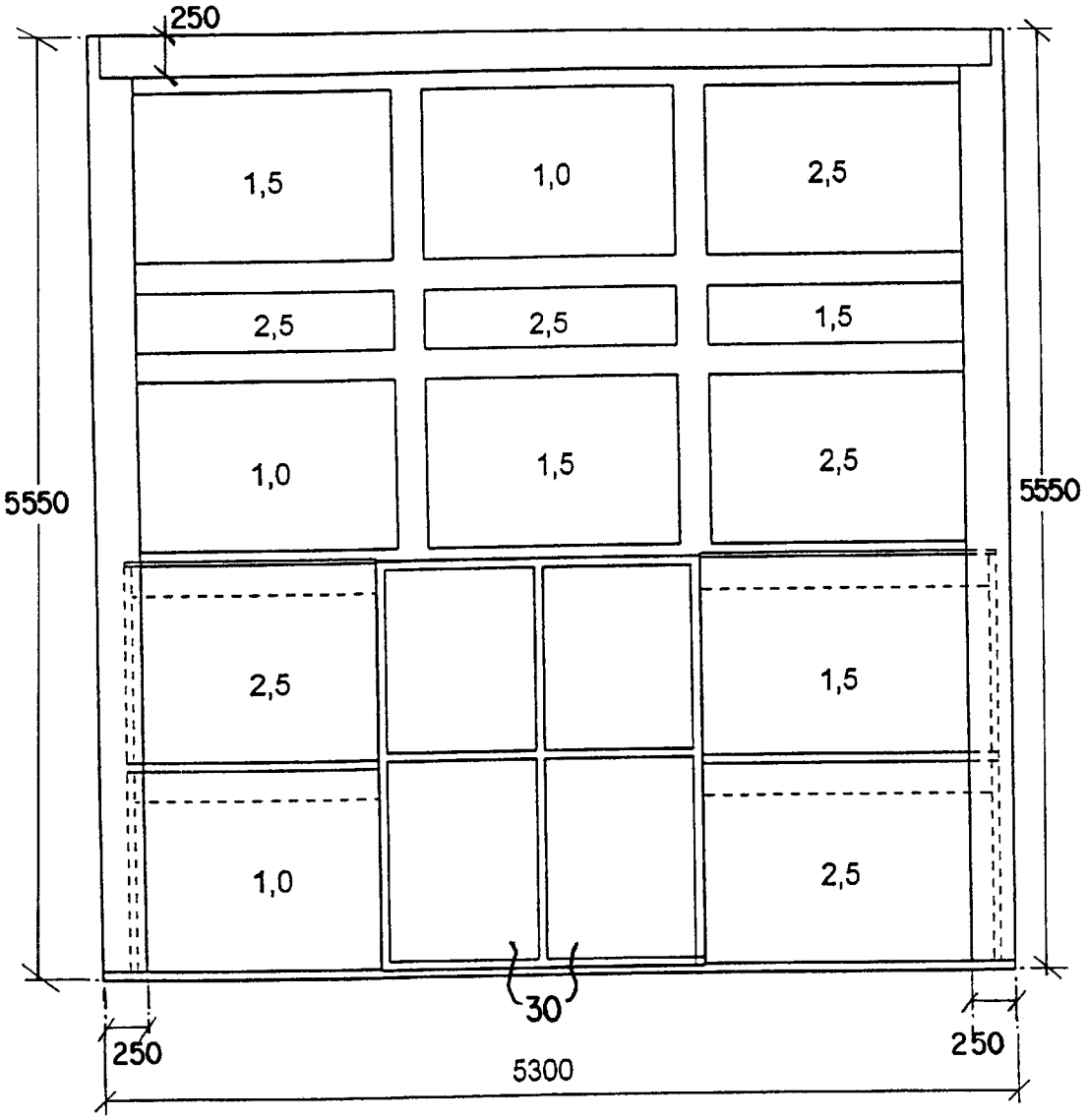
FIG. 15 is a plan view of wall B of the anechoic room as shown in FIG. 10, with modules configured thereon according to the invention.

In an embodiment of the current invention, a room originally built as a reverberation room (in massive concrete and approximately 240 $m^3$), was furnished as an anechoic room in the form of a semi-anechoic room (with a reflecting floor). FIG. 10 shows a developed view of the reverberant unfinished surfaces. FIG. 11 shows a sketch of the covering of the ceiling of absorber modules according to FIG. 10 with absorbers made of melamine resin foam and steel plates 3 of 1.0 to 2.5 mm thickness. Lamps 14 integrated according to FIGS. 7 and 11, provide good illumination of the room and good light reflection without reflecting sound. FIGS. 12 and 13 show the side walls A, D of the semi-anechoic room, FIGS. 14 and 15 its end walls C, B, the end wall B having a large two-wing door 30 with modules of only 250 mm thick melamine resin foam.

In accordance with DIN 45 635, Teil 1: Gerauschmessung an Maschinen (noise measurement on machines). Explanation of noise emission parameters and ISO 37 45: Acoustics—determination of sound proof levels of noise sources—Precision methods for anechoic and semi-anechoic rooms, the sound field around a point source of sound disposed on the reverberant floor fulfills precision class 1. This is true if, on the measuring radii r from the source in the corners at the top, the deviation from the −20 lg r level reduction does not exceed, at frequencies from 6 300 Hz up ±3.0 dB, from 800 to 5000 Hz ±2.0 dB and below 800 Hz ±2.5 dB.

This condition is fulfilled in the present preferred embodiment from 20 Hz up to 16 KHz for radii up to approximately 2 m from the source. However, at frequencies below 400 Hz, on a corresponding hemisphere placed about the source as a cover surface, another criterion of this norm is unfulfilled. Here, the measuring points should maintain a distance of $\lambda/4$ from the room covering. If one, however, does not adhere to these very conservative standards (which are also a result of experience at high frequencies with totally differently erected and differently acting anechoic coverings) one can hear and measure in the rooms according to an embodiment of the invention up to 20 Hz downward. This is practically the same effect as in a free sound field. In an equally large cuboid room, with a similar wall and ceiling covering (with a truly central disposition of the source), even somewhat larger maximum measuring radii, over 2, perhaps 2.5 m can be expected at free sound field conditions of 20 to 16 000 Hz.

Figure 16:
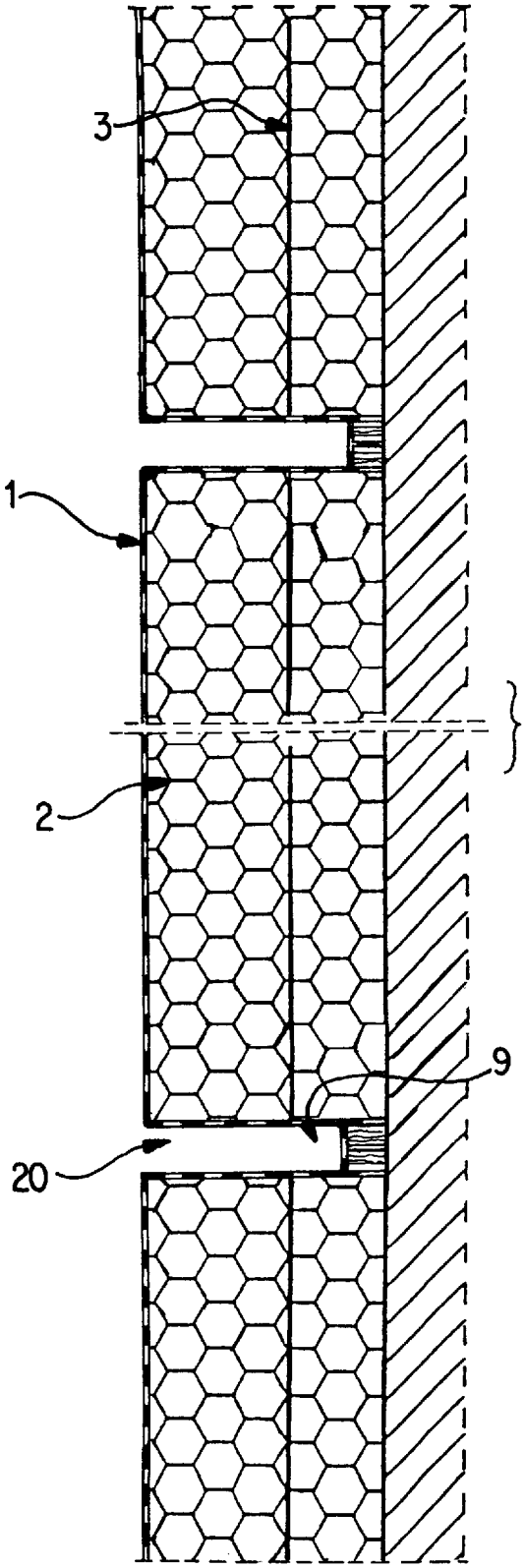
FIG. 16 shows a cross section of a wall covering with an open joint system, configured according to an embodiment of the invention.

The exemplary embodiment of the anechoic room is provided with a perforated cage cover according to FIG. 16 on one of the large wall surfaces (A) as well as on the front end wall (B) with the door 30. This is in contrast to the closed cover on the ceiling and on the second large wall (D). In no manner do the approximately 20 to 50 mm wide joints reduce absorption, but rather hide to some extent the unevenness of the massive wall and the inaccuracy of the module production and their perforated sheet covers. In FIG. 16 an open joint 20 is shown.

Figure 1A:
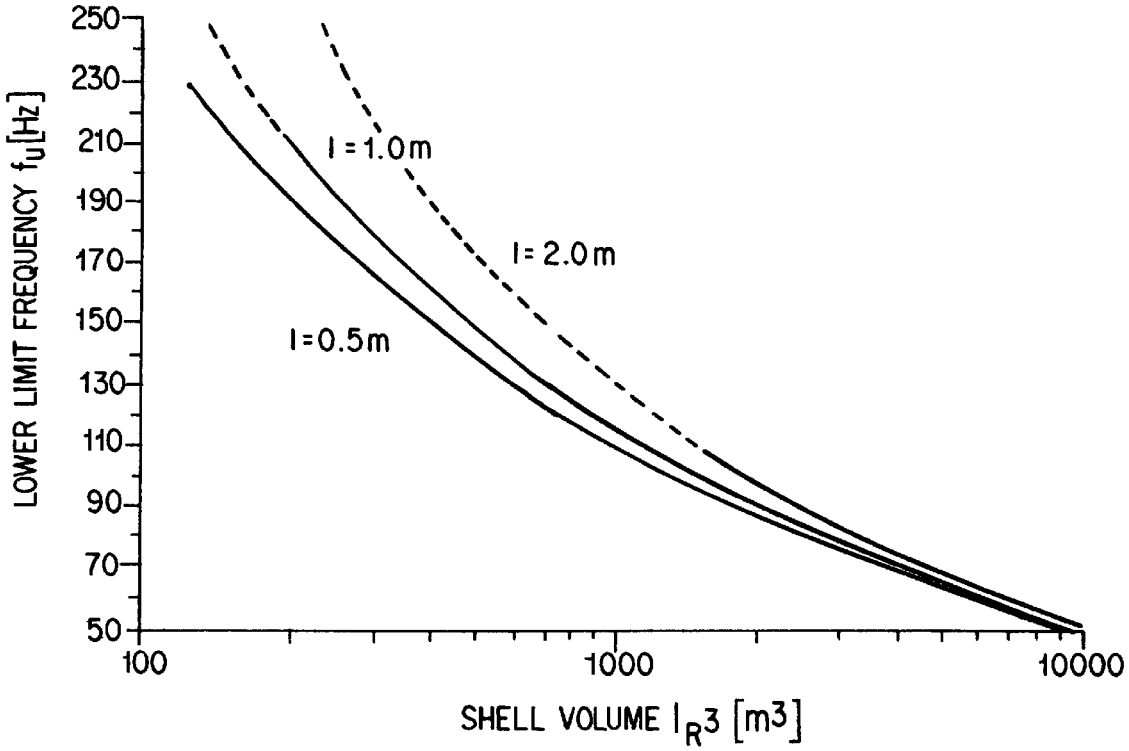
FIG. 1(*a*) is a graph that shows the relationship between the lower limit frequency and the volume of the unclad construction, along with the sound source for $d=t=\lambda/4$, in accordance with DIN.
Figure 1B:
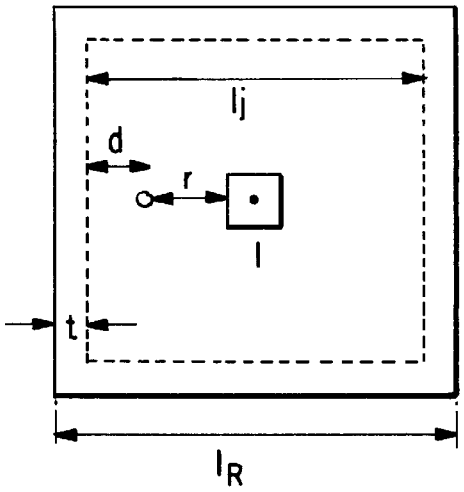
Figure 2D:
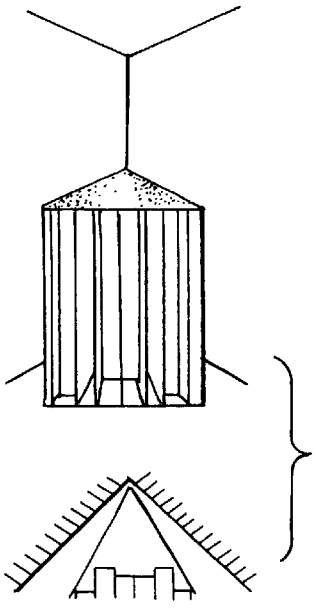
FIG. 2(*a*) thru 2(*d*) show embodiments of edge absorbers for monitoring rooms, in accordance with DIN 45 635.
Figure 2C:
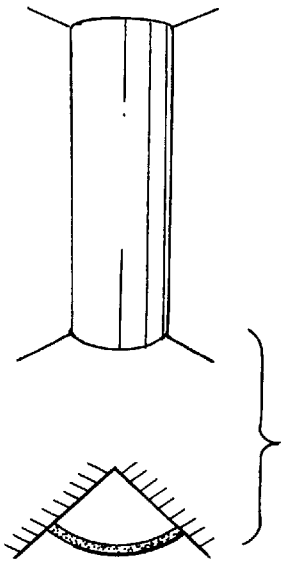
Figure 2B:
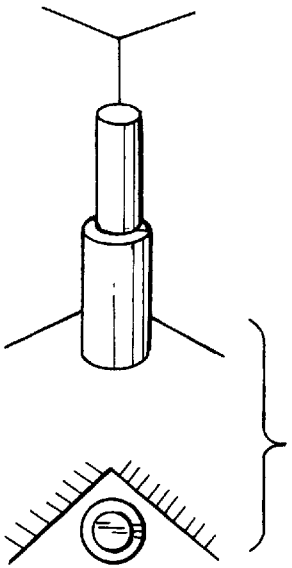
Figure 2A:
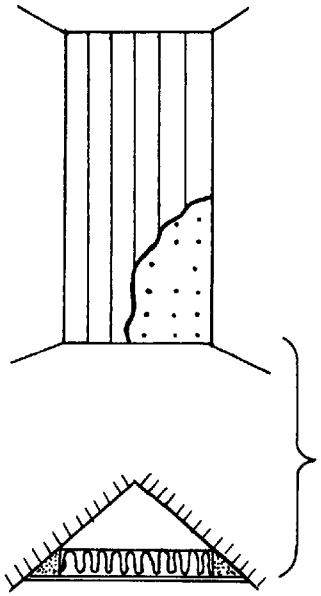
Figure 3:
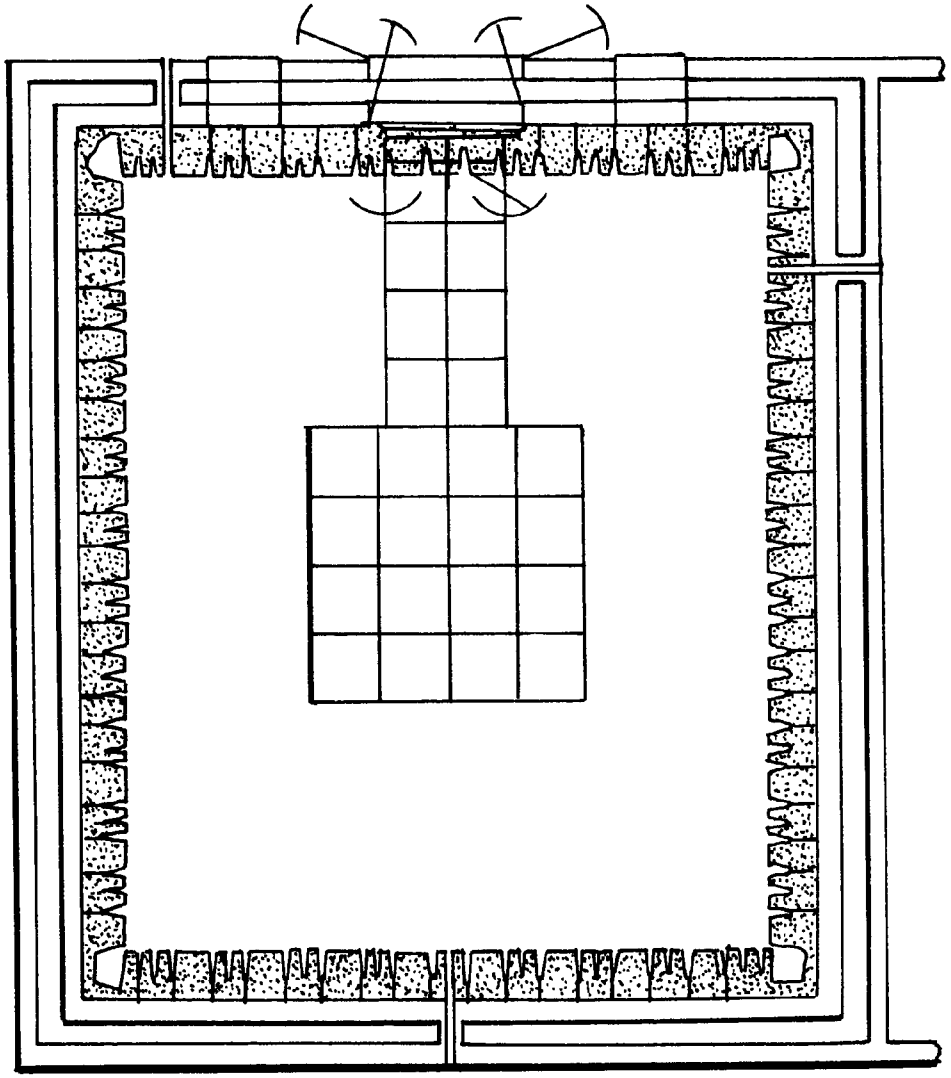
FIG. 3 shows a horizontal cross section through an anechoic room, according to the state-of-the-art.
Figure 4A:
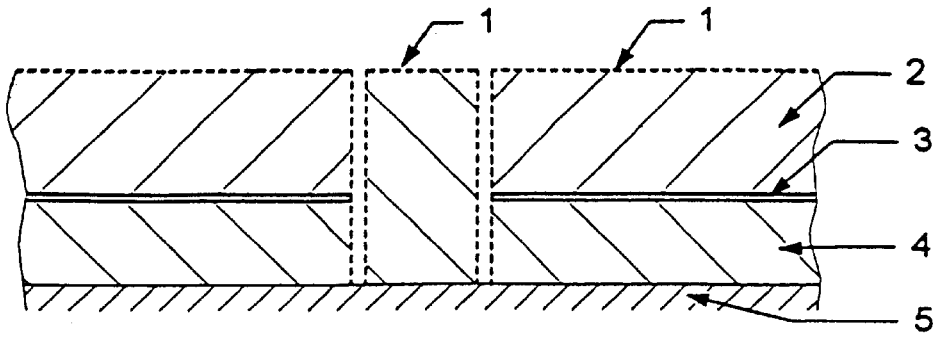
FIG. 4(*a*) shows the fundamental buildup of the covering of anechoic rooms, constituted according to a first preferred embodiment of the invention.
Figure 4B:
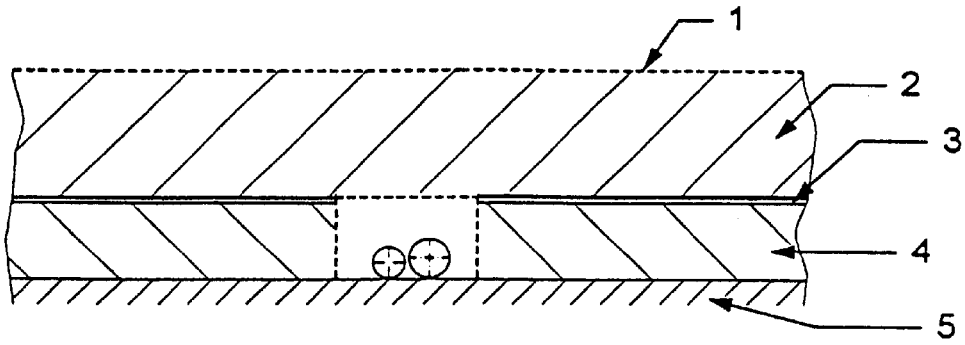
Figure 4C:
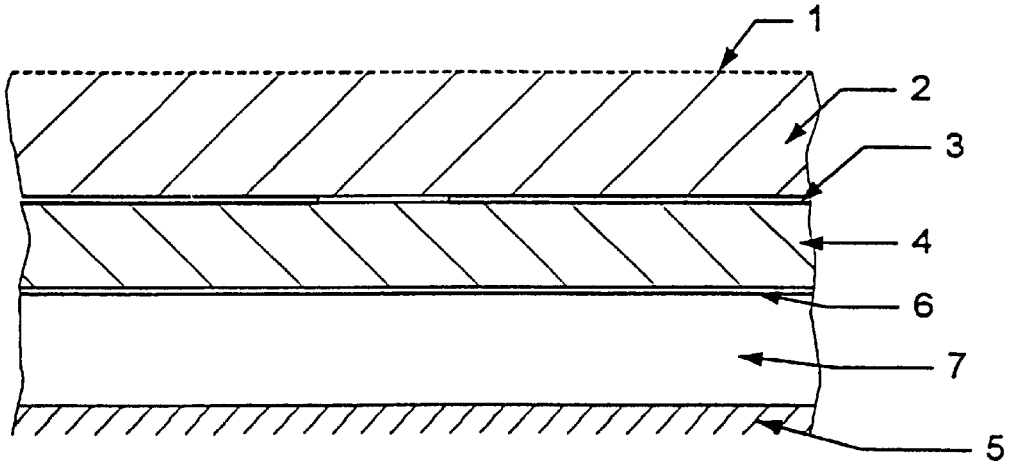

FIGS. 4(*a*) thru 4(*c*) show the fundamental buildup of the covering of an anechoic room, constructed according to embodiments of the invention. With respect to FIGS. 4 thru 7, the buildup of the walls is accomplished by using a sound transmitting covering 1 (such as a perforated plate or expanded metal); a homogeneous, porous or fibrous sound absorber 2 (for example, open-cell flexible foam or artificial mineral fibers with a thickness of approximately 150 mm and a flow resistance of between 1,000 and 3,000 $Ns/m^3$), a non-rigid elastic plate 3 (for example, metal or a heavy foil) with a basis weight between 1 and 25 $kg/m^2$; and a homogeneous, porous or fibrous plate 4 as a sound absorber acting as a spring element with a high internal friction (for example, open-cell highly resilient foam or synthetic mineral fibers). The homogeneous porous or fibrous plate 4 has a thickness of approximately 100 mm and a flow resistance between 500 and 2,000 $Ns/m^3$. The walls further have a massive wall 5 (for example, masonry or concrete).

According to the embodiment shown in FIG. 4(*a*), the open joint 20 (i.e., joint 20 shown in FIG. 16), is filled with the sound transmitting covering 1 (such as a perforated plate or expanded metal).

According to the embodiment shown in FIG. 4(*b*), lamp elements 14 (i.e, lamp element 14 shown in FIG. 7) are integrated into the sound absorber.

According to the embodiment shown in FIG. 4(*c*), in addition to the above components, the walls may further include an acoustically closed back wall 6 with a basis weight which is higher than or at least equal to that of the plate 3 and a hollow space 7 between the coated absorber and the massive wall 5 (thickness between a few millimeters and several meters, for example, in the case of a room-within-a-room construction).

Figure 5:
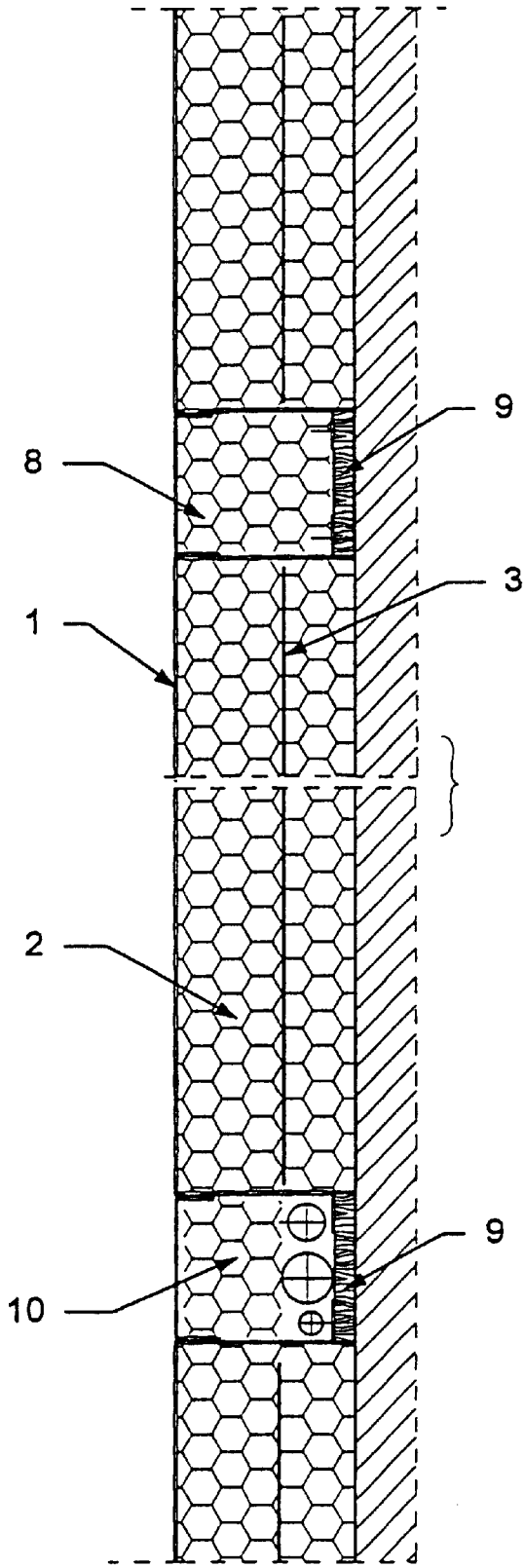
FIG. 5 shows a cross section of a wall covering with a closed joint system, constituted according to a preferred embodiment of the invention.

FIG. 5 shows a cross section of a wall covering with a closed joint system, constructed according to a preferred embodiment of the invention. Shown therein is a joint element 8, an substructure 9 (such as wood) and an installation element 10.

FIG. 6 depicts a cross section of a ceiling covering with a closed joint system, constructed according to a preferred embodiment of the invention. This embodiment further includes a space 11 for a lamp element and a lamp holder 12.

FIG. 7 shows a cross section of a closed joint system with a lamp element, according to a preferred embodiment of the invention. Here, a support 13 is shown that has a diameter D which is greater than or equal to 60 mm. In addition, a fluorescent lamp 14 in a conventional fitting is included. Usually, an electric fluorescent lamp ballast 15 ("choke")is used with fluorescent lamps. This ballast 15 is located, for example, in the position shown in FIG. 7.

Figure 8:
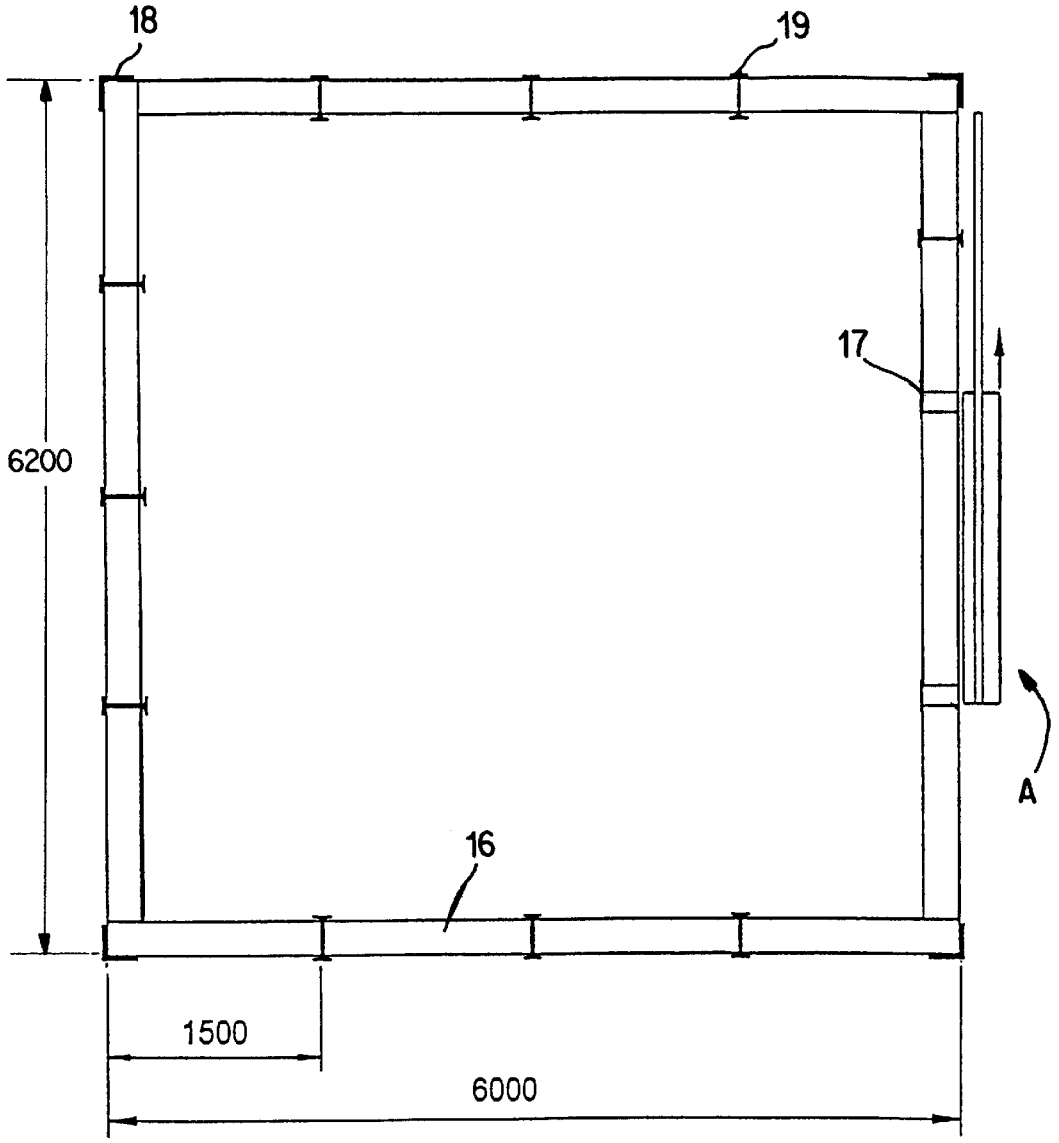
FIG. 8 is a plan view of monitoring and measuring rooms with modules inserted between stand constructions of I moldings, constituted according to a preferred embodiment of the invention.
Figure 9:
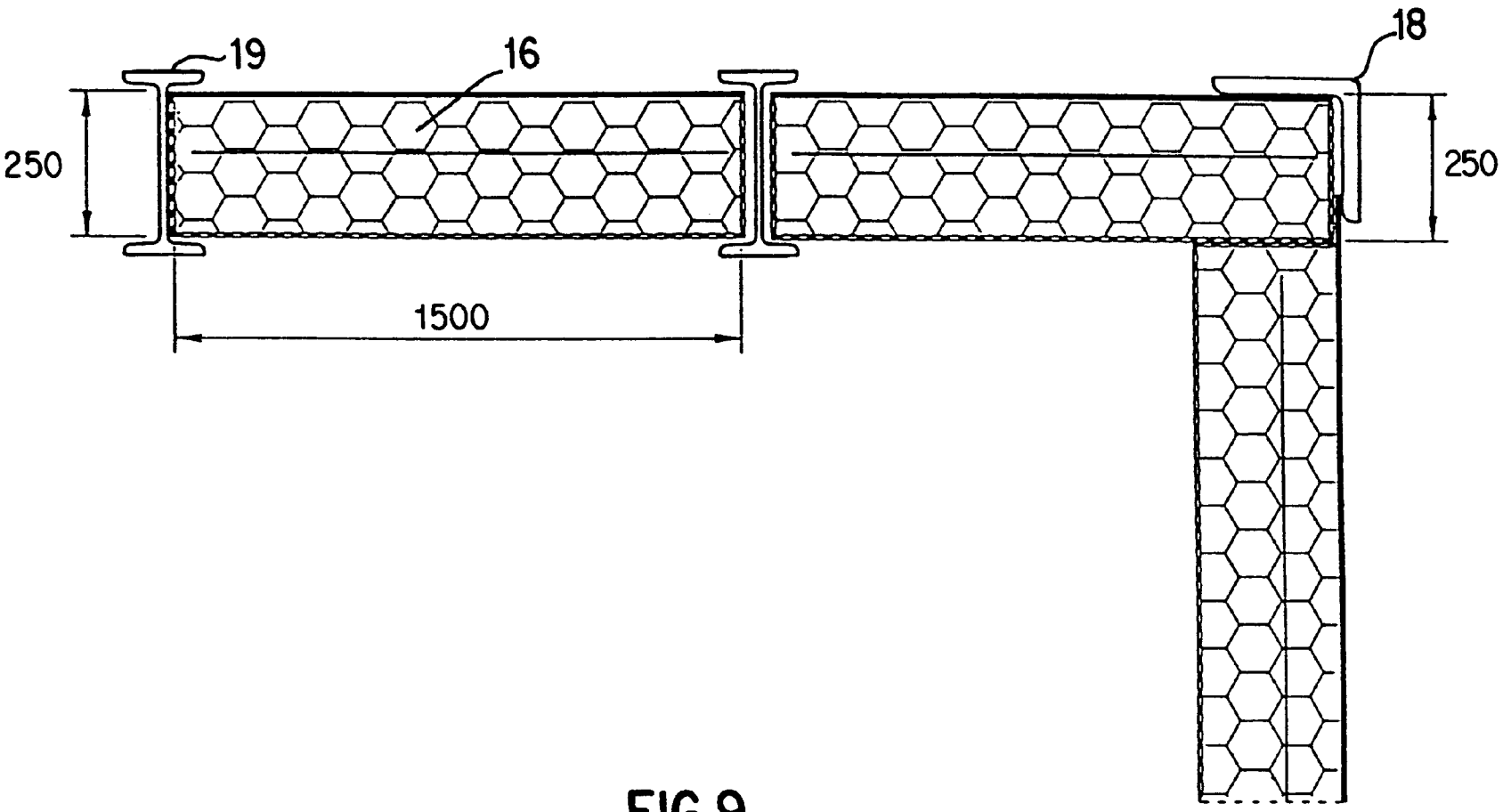
FIG. 9 shows a buildup of the wall of the monitoring and measuring rooms with modules inserted between stand constructions as shown in FIG. 8, according to a preferred embodiment of the invention.

FIG. 8 shows the wide-band compact absorber 16 (BKA) modules inserted between I moldings 19 (batten or stand structures). The I moldings 19 (for example, 320 mm) are utilized along the perimeter of the listening space. L moldings 18 (batten or stand structures, for example, 250 mm) are used to secure the corners of the listening space. Oblong hollow moldings 17 (batten or stand structures) are, for example, 260×140 mm.

The absorber constructed of layered plane plates is composed of, e.g., an approximately 150 mm thick porous or fibrous first layer 2 with a flow resistance of approximately 2 to 9 and an approximately 100 mm thick porous or fibrous second layer 4 with a flow resistance of approximately 1 to 6 (in relation to the characteristic impedance of air $\rho c$ with $\rho$=density and c=sound velocity of the air). The first layer 2, for its part, can also advantageously be constructed of multiple plane layers with increasing flow resistance from the room to the periphery of the room. The second porous or fibrous layer 4 should have a dynamic stiffness of approximately 1 to 20 $MN/m^3$. Various materials also employed for conventional sound absorbers, in a variety of applications, are available for both layers. Between both porous layers is a metal or plastic plate 3 glued pointwise thereto, having a basic weight of approximately 1 to 25 $kg/m^2$.

The front side, like the front ends of the individual absorber module, are covered with only acoustically permeable materials (e.g. perforated metal sheets and/or fiber nonwoven fabric) as protection against view and trickling, as is known from conventional sound absorbers and silencers. Thus, sound waves in the entire auditory range can penetrate layer 2 undisturbed. Moreover, low and medium frequencies can also penetrate the layer 4 laterally, and thus be absorbed there. Above all, however, the sound waves of low frequencies can reach plate 3 right through layer 2 and excite it as a mass, together with layer 4 like a spring of the mass/spring resonator type. In view of the fact that the two porous (or fibrous layers) act simultaneously as damping material for the plate vibrations, even very low frequency parts of the sound field can be very effectively absorbed. The construction depth of the anechoic room covering of approximately 250 mm remains very little compared to the wavelength of the lowest yet adequately absorbed frequency component.

Figure 17:
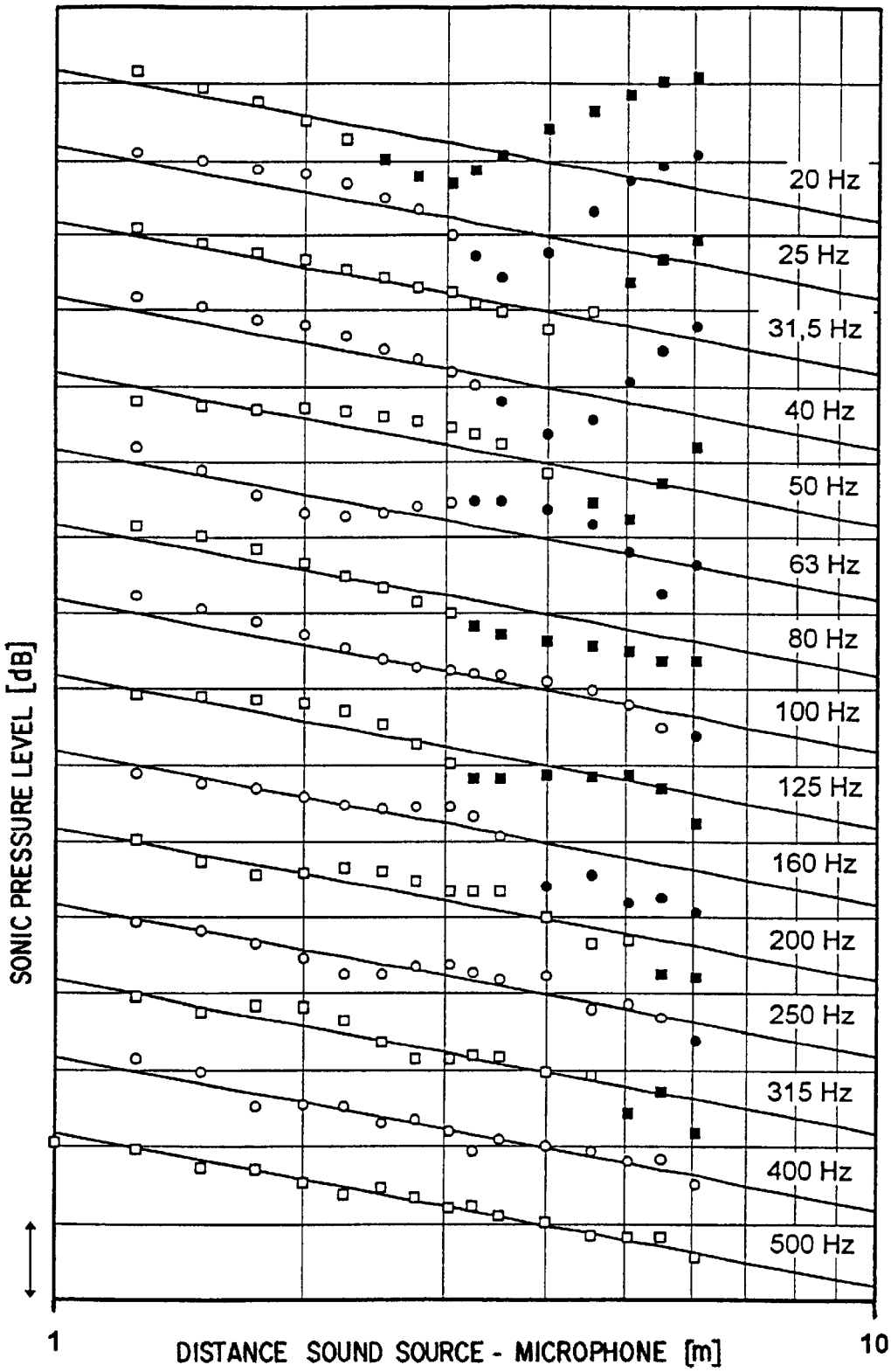
FIG. 17 is a graph showing sonic pressure reduction measurements in an anechoic room as shown in FIG. 10, configured according to the invention.
Figure 18:
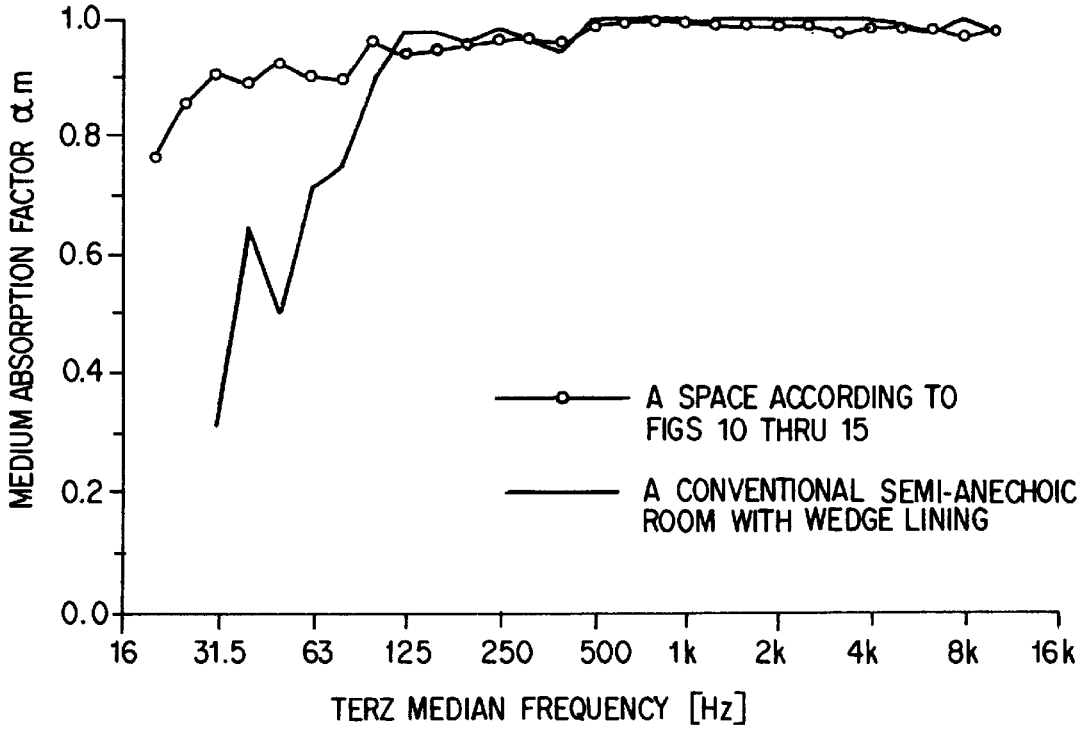
FIG. 18 shows the average absorption of the wall covering of the present invention with a depth of 250 mm as compared to a wall covered with a 650 mm thick conventional covering.

Using as an example a room with a width of barely 5 m, it was demonstrated how in a five-sided covering of an embodiment of the current invention, absorber modules can create free sound field conditions in a room for a point sound source disposed about in the center on the reverberant floor. Using deviations, marked with open symbols, of the measured values of the sound pressure level on a radius of the source to an edge of the room from the continuous straight line, FIG. 17 shows how the standards of precision class 1 in accordance with the above mentioned DIN norms are not broken until distances larger than 3 m (for 20 Hz: 2.25 m). FIG. 18 shows the (according to Diestel, H. G. : Messung des mittleren Reflexionsfaktors der Wandauskleidung in einem reflexionsarmen Raums (Measurement of the average reflection factor of the wall cladding of an anechoic room) Acustica 20 (1968), pp. 101–104) determined average absorption coefficient of the wall covering (according to the current invention) with only a depth of 250 mm, compared to that of a 650 mm thick conventional covering of a semi-anechoic room. Below 125 Hz, the thinner covering according to an embodiment of the invention is clearly superior to the thicker conventional one, whereas both variants seem to be practically the same at high frequencies up to 10 KHz.

However, the use of the wall covering according to the current invention is also advantageous in rooms with less theoretical requirements. For example, in rooms for audio use, as testing rooms for assessing loudspeakers DIN 45 537: Lautsprecher-Prüfverfahren. Messbedingungen und Messverfahren für Typprüfungen. Messungen unter Freifeld-Bedingungen. (DIN E 15 996: Bild- und Tonbearbeitung in Film-, Video- und Rundfunkbetrieben. Anforderungen und den Arbeitsplatz), and in studios having high-quality acoustics (ITU-R BS 1116: Methods for the subjective assessment of small impairments in audio systems including multichannel sound systems, Recommendation of the International Telecommunication Union (ITU), 1994).

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A low reverberating room for the entire auditory range, comprising:

at least one wall and ceiling covered with sound absorbers, said sound absorbers covering a surface of approximately 70–90% of the walls and ceiling, said sound absorbers having a closed plane, acoustically permeable surface;

wherein the sound absorbers include multiple layers and a plate made of metal or heavy foil having two sides with one of said layers contacting a first side of said plate and another one of said layers contacting a second side of said plate whereby said multiply layers and said plate form composite-plate resonators, which are designed of varying thickness for absorption in various frequency ranges.

2. A low reverberating room according to claim 1, wherein a remaining surface of the walls and ceiling which is not covered by said sound absorbers is covered with a fibrous or porous material as absorbers.

3. A low reverberating room according to claim 1, wherein at least one of said absorbers and said composite-plate resonators are provided on their front side with a cover made of perforated sheet metal or stretch metal with a hole/surface ratio of at least 30%.

4. A low reverberating room according to claim 1, wherein at least one of said absorbers and said composite-plate resonators are provided on their front side with a cover made of perforated sheet metal or stretch metal with a hole/surface ratio of at least 30%.

5. A low reverberating room according to claim 3, wherein said cover surrounds at least one of said entire composite-plate resonator and said absorber to form a cage.

6. A low reverberating room according to claim 1, wherein a floor of the room is covered with at least one of said composite-plate resonators or said absorbers.

7. A low reverberating room according to claim 1, wherein the room is for low frequencies below 100 Hz.

8. A low reverberating room according to claim 6, wherein said floor covered with said absorbers or said composite-plate resonators is designed treadable using a suited form-stable embodiment of said cover or the surface of the cover layer of said composite-plate resonators.

9. A low reverberating room according to claim 1, wherein said composite-plate resonators are laid with the thicker said plates lying toward the corners and edges of said room.

10. A low reverberating room according to claim 1, wherein said resonators define installation channels in the form of closeable hollow spaces or joints.

11. A low reverberating room according to claim 10, wherein lamps or spot lights are provided in said installation spaces.

12. A low reverberating room according to claim 11, wherein said lamps or spot lights have a conventional fitting disposed facing said room and in front of said sound-absorbing material and said lamps or spot lights have noise-generating parts disposed behind said absorber.

13. A low reverberating room according to claim 1, wherein said composite-plate resonators or said absorbers are disposed on a batten structure or a stand structure in front of said wall.

14. A low reverberating room according to claim 1, wherein a hollow space is provided behind said composite-plate resonator.

15. A low reverberating room according to claim 1, wherein said composite-plate resonators are designed as self-contained modules with a reverberant plate made of metal or heavy foil being provided as a rear wall.

16. A low reverberating room according to claim 1, wherein at one of least said plates of said composite-plate resonator are completely sheathed by said absorber or said layer.

17. A low reverberating room according to claim 1, wherein compensation joints are provided to compensate for unevenness in the floor, wall or ceiling.

18. The anechoic chamber according to claim 1, wherein said sound absorbers have a depth of less than 0.3.

19. An anechoic chamber, comprising:

walls and ceilings covered with sound absorbers; said sound absorbers including at least two sound absorbing layers arranged and inside plates with each one of said inside plates having a first surface contacting one of said at least two sound absorbing layers and a second surface contacting another one of said at least two sound absorbing layers; and wherein the sound absorbers cover approximately 70–90% of the walls and ceiling of the chamber.

20. The anechoic chamber according to claim 19, wherein said sound absorbers have a depth of less than 0.3.

21. The anechoic chamber according to claim 19, wherein said sound absorbers have a closed, plane but acoustically permeable surface.

22. The anechoic chamber according to claim 19, wherein said sound absorbers are built up of multiple layers to form composite-plate resonators.

23. The anechoic chamber according to claim 19, wherein a remaining surface of the walls and ceiling which is not covered by said sound absorbers is covered with a fibrous or porous material as absorbers.

24. The anechoic chamber according to claim 23, wherein at least one of said absorbers and said composite-plate resonators are provided on their front side with a cover made of perforated sheet metal or stretch metal with a hole/surface ratio of at least 30%.

25. The anechoic chamber according to claim 24, wherein a floor of the chamber is covered with at least one of said composite-plate resonators or said absorbers.

26. The anechoic chamber according to claim 19, wherein said resonators define installation channels in the form of closeable hollow spaces or joints.

27. The anechoic chamber according to claim 26, wherein lamps or spot lights are provided in said installation spaces.

28. The anechoic chamber according to claim 27, wherein said lamps or spot lights have a conventional fitting disposed facing said room and in front of said sound-absorbing material and said lamps or spot lights have noise-generating parts disposed behind said absorber.

29. A process for reducing reverberations in a room, comprising the steps of:

arranging a first sound absorbing layer on a first surface of an inside plate and arranging a second sound absorbing layer on a second surface of said inside plate to form a sound absorber; and covering walls and ceilings of said room with said sound absorbers;

wherein the sound absorbers have a depth of less than 0.5 m and cover approximately 70–90% of the walls and ceiling of the room.

30. The anechoic chamber according to claim 29, wherein said sound absorbers have a closed, plane but acoustically permeable surface.

31. The anechoic chamber according to claim 29, wherein said sound absorbers are built up of multiple layers to form composite-plate resonators.

32. The anechoic chamber according to claim 29, wherein 10–30% of the walls and ceiling are covered with a fibrous or porous material as absorbers.

33. A process for reducing reverberation in a low reverberating room for the entire auditory range, comprising the steps of:

covering at least one wall and ceiling of said room with sound absorbers, said sound absorbers covering a surface of about 70–90% of the walls and ceiling, said sound absorbers having a closed plane, acoustically permeable surface;

wherein the sound absorbers include multiple layers and a plate made of metal or heavy foil having two sides with one of said layers contacting a first side of said plate and another one of said layers contacting a second side of said plate whereby said multiply layers and said plate form composite-plate resonators; and varying the thickness of said plate for absorption in corresponding varying frequency ranges.

* * * * *